US007771164B2

(12) United States Patent
Manteiga et al.

(10) Patent No.: US 7,771,164 B2
(45) Date of Patent: Aug. 10, 2010

(54) METHOD AND SYSTEM FOR ASSEMBLING A TURBINE ENGINE

(75) Inventors: John Alan Manteiga, North Andover, MA (US); Clive Andrew Morgan, Cincinnati, OH (US); John Christopher Brauer, Lawrenceburg, IN (US); Todd Stephen Heffron, Harrison, OH (US)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 11/612,289

(22) Filed: Dec. 18, 2006

(65) Prior Publication Data

US 2008/0145218 A1 Jun. 19, 2008

(51) Int. Cl.
*F03B 3/16* (2006.01)

(52) U.S. Cl. ..... 415/209.3

(58) Field of Classification Search ..... 415/173.7, 415/189, 190, 191, 209.3; 29/889.22
See application file for complete search history.

(56) References Cited

U.S. PATENT DOCUMENTS

| | | | | | |
|---|---|---|---|---|---|
| 4,815,933 | A | * | 3/1989 | Hansel et al. | 415/189 |
| 4,870,818 | A | | 10/1989 | Suliga | |
| 5,372,476 | A | * | 12/1994 | Hemmelgarn et al. | 415/135 |
| 5,669,757 | A | | 9/1997 | Brackett | |
| 5,848,854 | A | | 12/1998 | Brackett | |
| 6,095,750 | A | * | 8/2000 | Ross et al. | 415/189 |
| 6,494,677 | B1 | | 12/2002 | Grady | |
| 6,893,217 | B2 | | 5/2005 | Brainch et al. | |
| 6,921,246 | B2 | | 7/2005 | Brainch et al. | |
| 6,935,837 | B2 | | 8/2005 | Moniz et al. | |

* cited by examiner

*Primary Examiner*—Edward Look
*Assistant Examiner*—Ryan H Ellis
(74) *Attorney, Agent, or Firm*—William Scott Andes, Esq.; Armstrong Teasdale LLP

(57) ABSTRACT

A method of assembling a turbine includes positioning a turbine nozzle against a forward inner nozzle support extending from a rotor assembly, and coupling a cover to the forward inner nozzle support. The method also includes inserting a tab that extends from the cover within at least one aperture defined in the turbine nozzle.

20 Claims, 4 Drawing Sheets

METHOD AND SYSTEM FOR ASSEMBLING A TURBINE ENGINE

BACKGROUND OF THE INVENTION

This invention relates generally to turbine engines and, more particularly, to methods and systems for assembling a turbine for use in a turbine engine.

At least some known turbine engines include mechanisms that are configured to retain a turbine nozzle during turbine assembly. Specifically, during turbine assembly, at least some known turbine nozzles are axially retained along a forward face of the nozzles to prevent each nozzle from shifting forward as other components are coupled within the engine. At least one known retaining mechanism includes an annular ring that is coupled between each nozzle and a forward inner nozzle support. The annular ring requires additional packaging space in the turbine and increases an overall weight of the turbine. Another, known retaining mechanism includes a plurality of tabs that extend from the nozzle. The tabs engage a cover that is used to shield a fastener used to couple the nozzle to the forward inner nozzle support. Although such tabs retain the nozzle during engine assembly, the tabs also require additional packaging space and increase the overall weight of the turbine.

Generally, in known turbines, to increase packaging space, the turbine nozzle must be positioned a large distance from an adjacent rotor. As such, a gap is defined between the nozzle and the rotor. During engine operation air discharged from the nozzle may be entrained in such gaps. As a result, an amount of air flow channeled towards the adjacent rotor may be reduced, which may result in turbine inefficiency. The gap may also reduce an amount of cooling air channeled over a trailing edge of the nozzle, which may adversely affect turbine performance. In addition, over time, the reduced cooling flow may shorten a useful life of the turbine and/or may cause maintenance costs associated with the turbine to increase.

BRIEF DESCRIPTION OF THE INVENTION

In one aspect, a method of assembling a turbine is provided, wherein the method includes positioning a turbine nozzle against a forward inner nozzle support extending from a rotor assembly, and coupling a cover to the forward inner nozzle support. The method also includes inserting a tab that extends from the cover within at least one aperture defined in the turbine nozzle.

In a further aspect, a turbine is provided, wherein the turbine includes a forward inner nozzle support extending from a rotor assembly, and a turbine nozzle positioned against the forward inner nozzle support and including at least one aperture defined therein. The turbine also includes a cover coupled to the forward inner nozzle support and including a tab that is inserted within the at least one aperture of the turbine nozzle.

In another aspect, a turbine engine including at least one turbine is provided. The at least one turbine includes a forward inner nozzle support extending from a rotor assembly, and a turbine nozzle positioned against the forward inner nozzle support and including at least one aperture defined therein. The at least one turbine also includes a cover coupled to the forward inner nozzle support and including a tab that is inserted within the at least one aperture of the turbine nozzle to retain the turbine nozzle during turbine assembly.

DETAILED DESCRIPTION OF THE INVENTION

The present invention provides a method and system for assembling a turbine engine. Specifically, in the exemplary embodiment, the turbine includes a forward inner nozzle support and a turbine nozzle coupled to the forward inner nozzle support. The turbine nozzle includes at least one aperture defined therein. A cover is coupled to the forward inner nozzle support, and a tab extending from the cover is inserted within the nozzle aperture to facilitate assembly of the turbine engine.

Although the present invention is described below in reference to its application in connection with a gas turbine engine, it should be apparent to those skilled in the art and guided by the teachings herein provided that with appropriate modification, the system and methods of the present invention can also be suitable for any engine, including, but not limited to, steam turbine engines.

Figure 1:
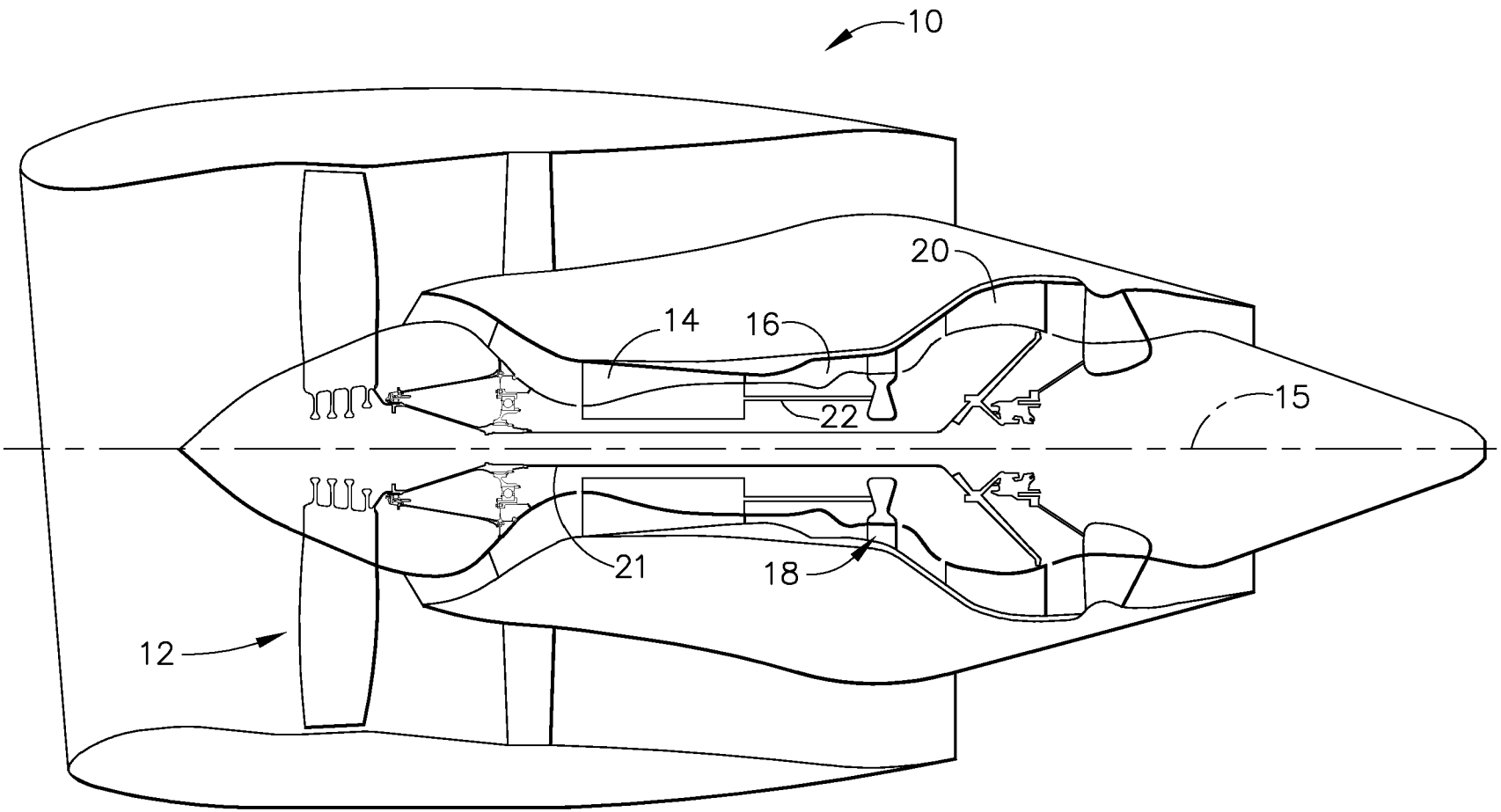
FIG. 1 is a schematic illustration of an exemplary gas turbine engine.

FIG. 1 is a schematic illustration of an exemplary gas turbine engine 10. Engine 10 includes a low pressure compressor 12, a high pressure compressor 14, and a combustor assembly 16. Engine 10 also includes a high pressure turbine 18, and a low pressure turbine 20 arranged in a serial, axial flow relationship. Compressor 12 and turbine 20 are coupled by a first shaft 21, and compressor 14 and turbine 18 are coupled by a second shaft 22.

In operation, air flows through low pressure compressor 12 supplying compressed air from low pressure compressor 12 to high pressure compressor 14. The highly compressed air is delivered to combustor 16. Airflow from combustor 16 is channeled through a turbine nozzle to drive turbines 18 and 20, prior to exiting gas turbine engine 10 through an exhaust nozzle.

Figure 2:
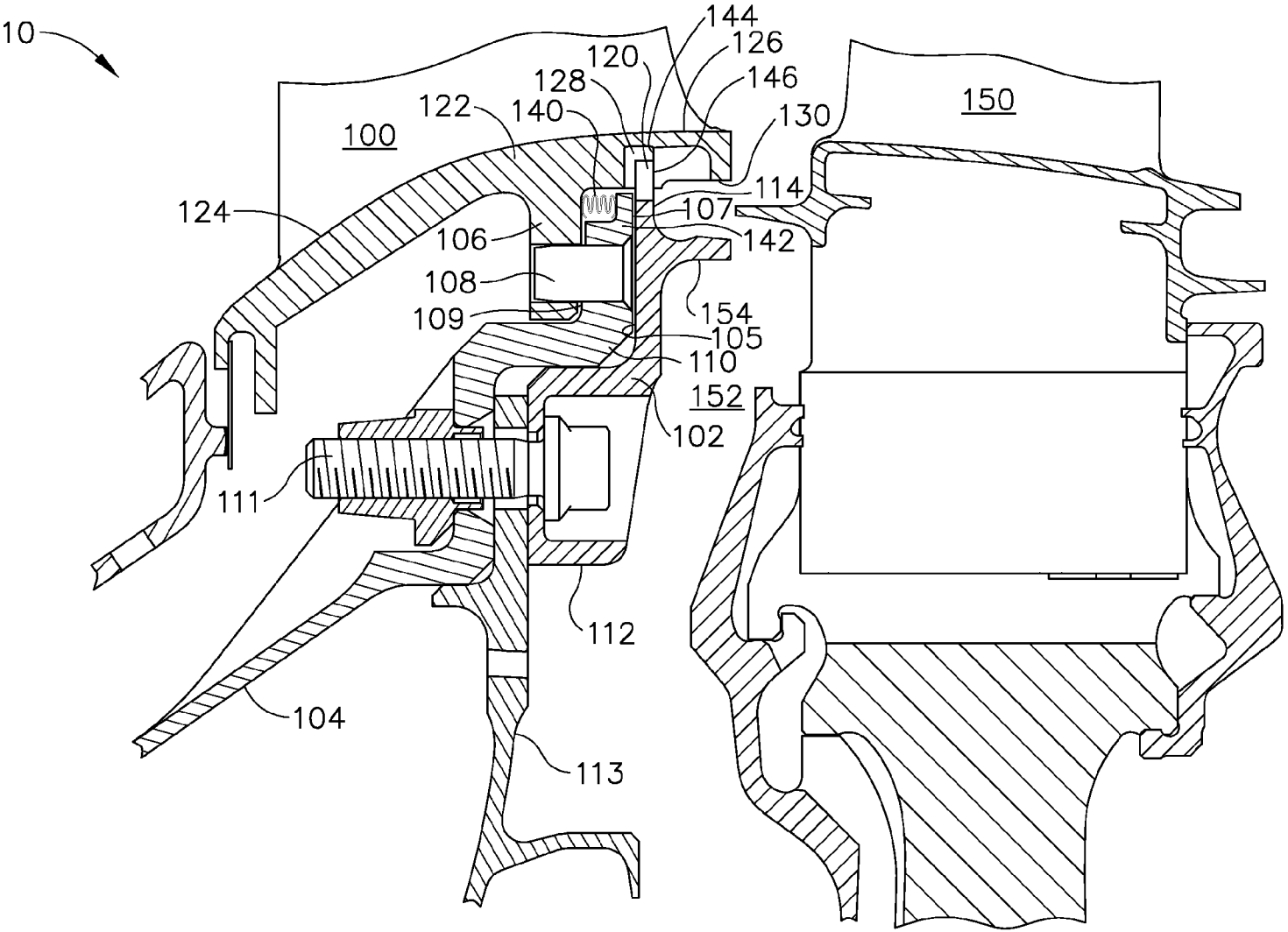
FIG. 2 is an enlarged schematic illustration of a portion of the gas turbine engine, shown in FIG. 1.
Figure 3:
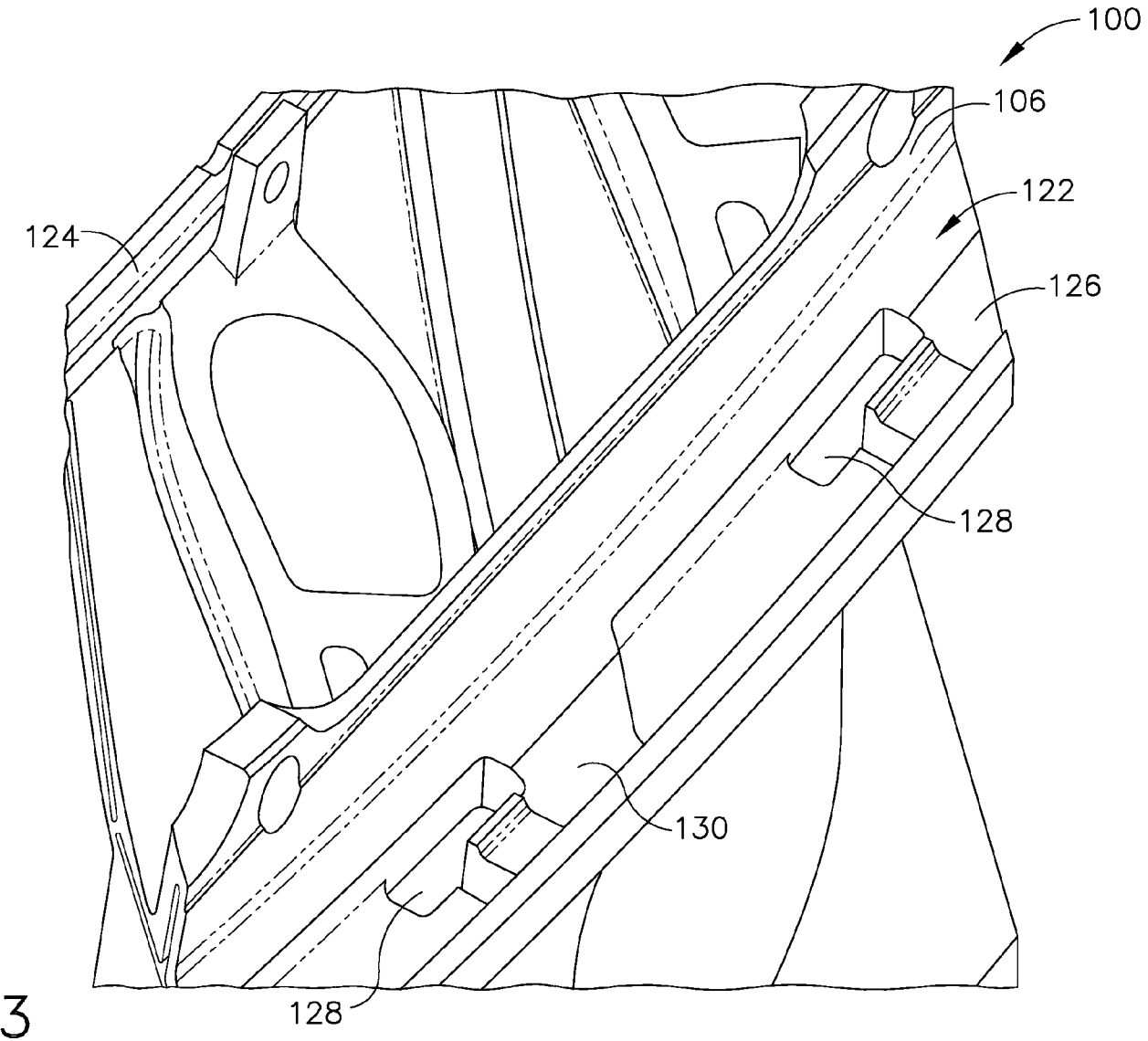
FIG. 3 is a view of a portion of an exemplary turbine nozzle that may be used with the gas turbine engine, shown in FIG. 1.
Figure 4:
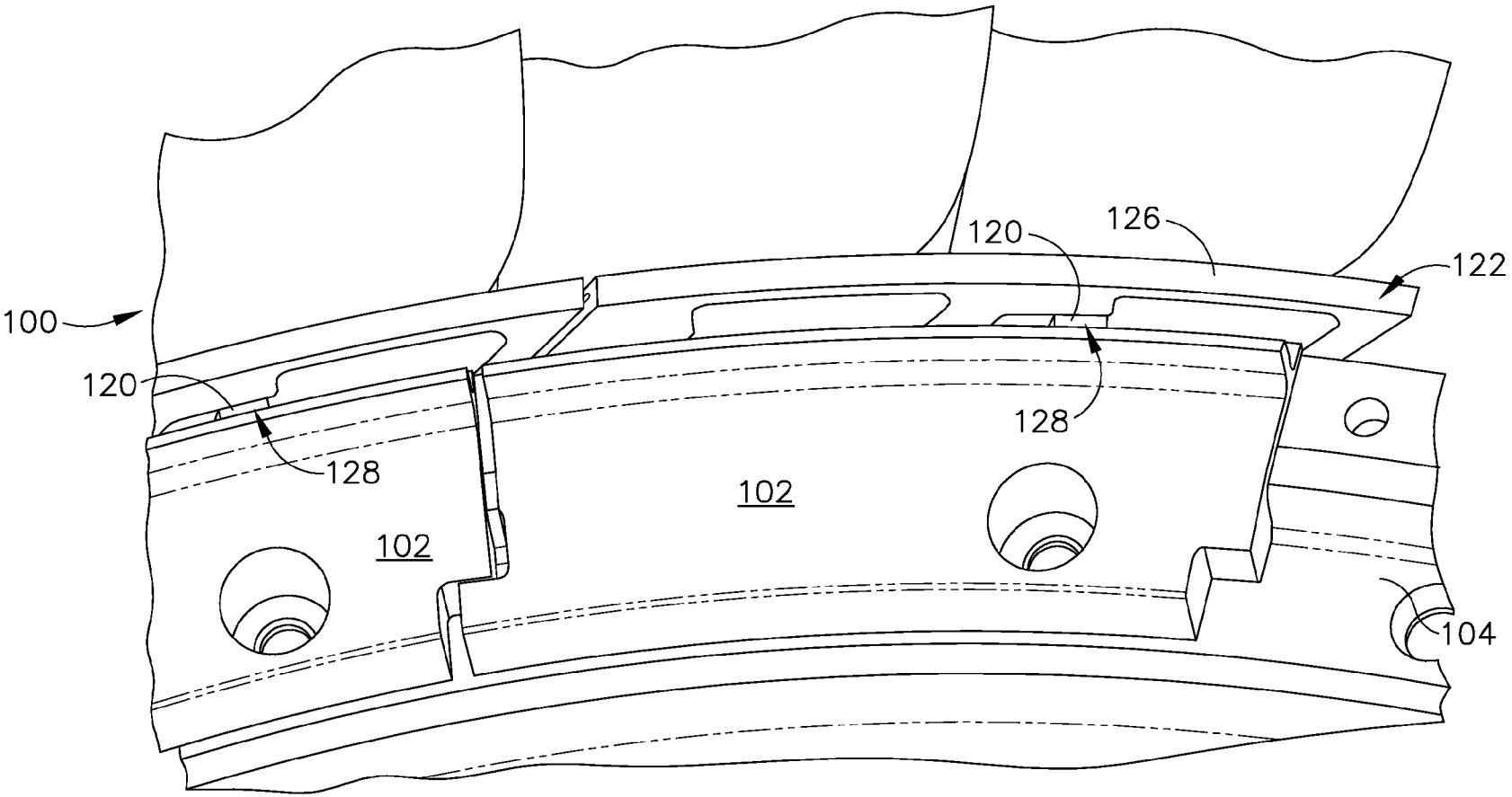
FIG. 4 is a view of an exemplary cover that may be used with the turbine nozzle, shown in FIG. 3.

FIG. 2 is an enlarged schematic illustration of a portion of gas turbine engine 10. FIG. 3 is a view of an exemplary turbine nozzle 100 that may be used with gas turbine engine 10. FIG. 4 is a view of an exemplary cover 102 that may be used with turbine nozzle 100. Although the present invention is described with respect to high pressure turbine 18, as will be appreciated by one skilled in the art, the present invention may likewise be used with low pressure turbine 20 or any other suitable turbine. Moreover, in the exemplary embodiment, turbine nozzle 100 is a first stage nozzle, but the present invention is not limited to only being used with the first stage of a turbine engine.

In the exemplary embodiment, turbine 18 includes a forward inner nozzle support 104 that is coupled to turbine nozzle 100 and cover 102. Specifically, forward inner nozzle support 104 is coupled to a casing (not shown) of turbine 18 and extends generally radially outward toward turbine nozzle 100. Turbine nozzle 100 is coupled to forward inner nozzle support 104 and, more specifically, is coupled radially outward from forward inner nozzle support 104. A plurality of circumferentially spaced pins 108 extend through an aft flange 106 of turbine nozzle 100 and forward inner nozzle support 104. In the exemplary embodiment, pins 108 are configured to prevent circumferential rotation of turbine nozzle 100 relative to forward inner nozzle support 104. In the exemplary embodiment, turbine nozzle 100 is coupled to a forward end 109 of forward inner nozzle support 104.

In addition, a forward-facing surface 105 of cover 102 is coupled flush to an aft facing surface 107 of an aft end 110 of forward inner nozzle support 104. Specifically, a second fastening mechanism 111 couples cover 102 to aft end 110 of forward inner nozzle support 104. More specifically, in the exemplary embodiment, fastening mechanism 111 couples a circumferential coupling portion 112 of cover 102 to a portion 113 of turbine 18 and forward inner nozzle support 104. In the exemplary embodiment, circumferential coupling portion 112 facilitates shielding fastening mechanism 111 to facilitate preventing windage in the turbine. Moreover, in the exemplary embodiment a radially outer portion 114 of cover 102 extends radially outward from circumferential coupling portion 112 and facilitates shielding pin 108 to facilitate preventing windage in the turbine.

Moreover, in the exemplary embodiment, cover 102 also includes a tab 120 that extends radially outward from radially outer portion 114. Tab 120 is sized and oriented to couple to turbine nozzle 100 to facilitate retaining turbine nozzle 100 during assembly. Specifically, tab 120 is coupled to an inner band 122 of turbine nozzle 100. More specifically, in the exemplary embodiment, inner band 122 includes a forward end 124 and an aft end 126 that includes at least one aperture 128 defined therein. In the exemplary embodiment, as shown in FIG. 3, aperture 128 is a slotted opening that extends across a radially inward face 130 of inner band 122. In an alternative embodiment, aperture 128 may have any shape suitable that enables cover 102 to function as described herein. Further, in the exemplary embodiment, tab 120 is sized and oriented to be slidably positioned and retained within aperture 128 to facilitate retaining turbine nozzle 100 as other components are coupled within engine 10.

In the exemplary embodiment, a biasing mechanism 140 is positioned between, turbine nozzle aft flange 106 and a radially outer end 142 of forward inner nozzle support 104. Biasing mechanism 140 facilitates biasing turbine nozzle 100 forward, such that an inner surface 144 of aperture 128 is positioned against an aft surface 146 of tab 120. Specifically, inner surface 144 is frictionally retained against aft surface 146.

A rotor 150 is coupled downstream from turbine nozzle 100 for receiving air discharged from turbine nozzle 100. More specifically, when rotor 150 is coupled in position, a gap 152 is defined between turbine nozzle 100 and rotor 150. Cover 102 is coupled within gap 152 to facilitate limiting the amount of air flow discharged from turbine nozzle 100 that may flow into and through gap 152. Moreover, cover 102 is coupled against pins 108 and fastening mechanisms 111 to provided a relatively smooth flow surface, and facilitate reducing an amount of interrupted surfaces defined in gap 152 that may undesirably entrain air flow from turbine nozzle 100. Moreover, in the exemplary embodiment, cover 102 includes a flange 154 that extends downstream towards rotor 150. Flange 154 facilitates reducing an amount of air flow that may enter gap 152.

During turbine assembly, in the exemplary embodiment, turbine nozzle 100 is positioned against forward inner nozzle support 104. Specifically, aft flange 106 is positioned against forward inner nozzle support 104. Moreover, cover 102 is also coupled to forward inner nozzle support via fastening mechanism 111. Specifically, cover 102 is coupled, such that cover 102 shields fastening mechanism 111. Further, cover 102 is coupled, such that tab 120 of cover 102 is positioned within aperture 128 of turbine nozzle 100.

Biasing mechanism 140 biases turbine nozzle 100 forward, such that inner surface 144 of aperture 128 is biased towards aft surface 146 of tab 120. Specifically, inner surface 144 is biased into contact with aft surface 146, such that aft surface 146 frictionally retains inner surface 144. Accordingly, turbine nozzle 100 is secured in position via pin 108 and a friction fit between inner surface 144 and aft surface 146. As such, turbine nozzle 100 is facilitated to be prevented from shifting as other components are coupled within engine 10. In particular, the friction fit between inner surface 144 and aft surface 146 provides added retention to facilitate preventing turbine nozzle 100 from shifting forward.

During engine operation, turbine nozzle 100 facilitates directing air flow to rotor 150 to drive turbine 18. Because tab 120 is inserted into aperture 128 during assembly, gap 152 is minimized because turbine nozzle 100 can be positioned closer to rotor 150, in comparison to turbines that utilize known retention mechanisms. As such, a greater amount of airflow is facilitated to be channeled towards rotor 150. Specifically, by positioning turbine nozzle 100 closer to rotor 150 an amount of air flow into gap 152 is facilitated to be reduced and an amount of air flow towards rotor 150 is facilitated to be increased. In addition, flange 154 extends radially into gap 152 to further facilitate reducing an amount of airflow into gap 152. Moreover, cover 102 facilitates providing a smooth flow path for air flow that may be entrained into gap 152. Specifically, the smooth flow path enables air to flow uninterrupted through gap 152 and facilitates reducing windage in the turbine 18.

In the exemplary embodiment, inserting tab 120 into aperture 128 facilitates providing addition retention of turbine nozzle 100 during engine assembly. Specifically, the combination of pin 108, tab 120 and aperture 128 facilitates preventing shifting of turbine nozzle 100 during engine assembly. More particularly, turbine nozzle 100 is prevented from shifting forward during assembly. Moreover, in the exemplary embodiment, the above described retention mechanisms facilitate increasing an efficiency of turbine engine 10.

Specifically, increased air flow from turbine nozzle 100 to rotor 150, during engine operation, facilitates increasing an efficiency of engine 10. More specifically, the increased air flow facilitates increasing the efficiency of rotor 150 and any other subsequent rotors within turbine 18. Moreover, the increased air flow facilitates increasing an amount of cooling air that flows over a nozzle trailing edge during engine operation. As such, turbine nozzle efficiency and/or a useful life of the turbine nozzle is facilitated to be increased. In addition, utilizing tab 120 and aperture 128 reduces a weight of turbine 18, such that turbine engine efficiency and/or a useful life of the turbine engine is facilitated to be increased.

In one embodiment, a method of assembling a turbine is provided, wherein the method includes positioning a turbine nozzle against a forward inner nozzle support extending from a rotor assembly, and coupling a cover to the forward inner nozzle support. The method also includes inserting a tab that extends from the cover within at least one aperture defined in the turbine nozzle.

The present invention provides a method and system for coupling a nozzle within a turbine of a turbine engine, such that a space defined between the nozzle and an adjacent rotor is minimized. Further, the present invention enables the nozzle to be coupled within the turbine without a need for retention rings or tabs extending from a nozzle inner band. As such, the present invention facilitates reducing an overall weight of the turbine by reducing the number and weight of components used therein. Moreover, by minimizing the space defined between the nozzle and an adjacent rotor, air flow losses within the turbine are facilitated to be reduced, thereby providing enhanced cooling of a nozzle trailing edge and/or improved turbine efficiency. As such, the present invention facilitates reducing an overall weight of the engine, increasing an efficiency of the engine, and/or reducing costs associated with production, assembly, and/or maintenance of the engine.

While the invention has been described in terms of various specific embodiments, those skilled in the art will recognize that the invention can be practiced with modification within the spirit and scope of the claims.

What is claimed is:

1. A method of assembling a turbine, said method comprising:

positioning a turbine nozzle against a forward inner nozzle support extending from a rotor assembly;

coupling a cover to the forward inner nozzle support;

inserting a tab that extends from the cover within at least one aperture defined in the turbine nozzle; and biasing the turbine nozzle in a forward direction such that an inner surface of the aperture is positioned against an aft surface of the tab wherein the inner surface of the aperture is frictionally retained against the aft surface of the tab.

2. A method in accordance with claim 1 further comprising inserting a tab that extends from the cover within at least one aperture defined in an inner band of the turbine nozzle.

3. A method in accordance with claim 1 further comprising:

coupling the forward inner nozzle support within the turbine with a fastening mechanism; and shielding the fastening mechanism with the cover.

4. A method in accordance with claim 3 further comprising shielding the fastening mechanism with the cover to facilitate reducing windage in the turbine.

5. A method in accordance with claim 1 further comprising coupling a cover having a flange that extends axially into a gap defined between the turbine nozzle and an adjacent turbine rotor to the forward inner nozzle support.

6. A method in accordance with claim 1 further comprising minimizing a gap defined between the turbine nozzle and an adjacent turbine rotor.

7. A method in accordance with claim 1 further comprising positioning a tab that extends from the cover within at least one aperture defined in the turbine nozzle to facilitate retaining the turbine nozzle during turbine assembly.

8. A turbine comprising:

a forward inner nozzle support extending from a rotor assembly;

a turbine nozzle positioned against said forward inner nozzle support and comprising at least one aperture defined therein; and a cover coupled flush to said forward inner nozzle support and comprising a tab that is inserted within said at least one aperture of said turbine nozzle, said turbine nozzle biased in a forward direction such that an inner surface of the aperture is positioned against an aft surface of the tab wherein the inner surface of the aperture is frictionally retained against the aft surface of the tab.

9. A turbine in accordance with claim 8 wherein said turbine nozzle further comprises an inner band having a forward end and an aft end, said at least one aperture defined in said aft end of said inner band.

10. A turbine in accordance with claim 8 further comprising a fastening mechanism configured to couple said forward inner nozzle support within said turbine, said cover configured to shield said fastening mechanism.

11. A turbine in accordance with claim 10 wherein said cover is configured to shield said fastening mechanism to facilitate reducing windage in said turbine.

12. A turbine in accordance with claim 8 wherein said cover further comprises a flange extending axially into a gap defined between said turbine nozzle and an adjacent turbine rotor.

13. A turbine in accordance with claim 8 wherein said tab extending from said cover and said at least one aperture are configured to minimize a gap defined between said turbine nozzle and an adjacent turbine rotor.

14. A turbine in accordance with claim 8 wherein said tab extending from said cover and said at least one aperture are configured to retain said turbine nozzle during turbine assembly.

15. A turbine engine comprising at least one turbine, wherein said at least one turbine comprises:

a forward inner nozzle support extending from a rotor assembly;

a turbine nozzle positioned against said forward inner nozzle support and comprising at least one aperture defined therein; and a cover coupled flush to said forward inner nozzle support and comprising a tab that is inserted within said at least one aperture of said turbine nozzle to retain said turbine nozzle during turbine assembly, said turbine nozzle biased in a forward direction such that an inner surface of the aperture is positioned against an aft surface of the tab wherein the inner surface of the aperture is frictionally retained against the aft surface of the tab.

16. A turbine engine in accordance with claim 15 wherein said turbine nozzle further comprises an inner band having a forward end and an aft end, said at least one aperture defined in said aft end of said inner band.

17. A turbine engine in accordance with claim 15 wherein said at least one turbine further comprises a fastening mechanism configured to couple said forward inner nozzle support within said at least one turbine, said cover configured to shield said fastening mechanism.

18. A turbine engine in accordance with claim 17 wherein said cover is configured to shield said fastening mechanism to facilitate reducing windage in said turbine.

19. A turbine engine in accordance with claim 15 wherein said cover further comprises a flange extending axially into a gap defined between said turbine nozzle and an adjacent turbine rotor.

20. A turbine engine in accordance with claim 15 wherein said tab extending from said cover and said at least one aperture are configured to minimize a gap defined between said turbine nozzle and an adjacent turbine rotor.

* * * * *